United States Patent [19]

Eng

[11] Patent Number: 4,830,040

[45] Date of Patent: May 16, 1989

[54] AUTOMATIC SWIMMING POOL COVER DRAINER

[76] Inventor: Ernest Eng, 22 Parker Ave., New City, N.Y. 10956

[21] Appl. No.: 222,625

[22] Filed: Jul. 21, 1988

[51] Int. Cl.[4] ..... F04F 10/00

[52] U.S. Cl. ..... 137/135; 4/198; 137/140; 137/399; 137/400; 137/448

[58] Field of Search ..... 4/198; 137/135, 140, 137/398, 399, 400, 448

[56] References Cited

U.S. PATENT DOCUMENTS

| | | | |
|---|---|---|---|
| 301,391 | 7/1884 | Reinecke . | |
| 499,059 | 6/1893 | Traver | 137/399 |
| 1,025,608 | 5/1912 | Bliss . | |
| 1,068,995 | 7/1913 | Ferrero . | |
| 2,542,591 | 2/1951 | Streety et al. | 137/398 X |
| 3,757,812 | 9/1973 | Duncan | 137/142 |
| 4,168,717 | 9/1979 | Rinker | 137/135 |
| 4,318,421 | 3/1982 | Ward . | |

FOREIGN PATENT DOCUMENTS

| | | | |
|---|---|---|---|
| 488402 | 7/1938 | United Kingdom | 137/400 |

*Primary Examiner*—Gerald A. Michalsky
*Attorney, Agent, or Firm*—Terry M. Geinstein

[57] ABSTRACT

A float controlled siphon discharge valve mechanism operates to drain water from a swimming pool cover, and includes a lever arm attached at one end to a hinge and having a float on the other end so that the lever is of the second or third type. A closure control is also included to sense for the presence of water immediately adjacent to the drain opening, and includes a spring loaded control arm connected to the lever arm to force the lever arm into a drain occluding position even if the float does not move that lever arm into such a position in order to ensure that the siphon is not broken even in the event that the float operation malfunctions.

6 Claims, 1 Drawing Sheet

AUTOMATIC SWIMMING POOL COVER DRAINER

TECHNICAL FIELD OF THE INVENTION

The present invention relates to the general field of float controlled valves, and relates in particular to float controlled siphon valves. Specifically, the present invention relates to a float controlled siphon valve for draining accumulated water from a swimming pool cover.

BACKGROUND ART

Many swimming pools are often covered during part of the year. Many swimming pool covers are quite strong, but since most of the popular swimming pool covers are flexible, and many swimming pools are large, there is a tendency for the pool cover to sag within the perimeter of the pool. Water then tends to collect or accumulate in the lower portions of the sagging pool cover. Since water is heavy, if water is permitted to accumulate undrained from the pool cover, even the strongest cover can be damaged by a large accumulation of water.

Many pool owners and attendants remove accumulated water by hand, but this becomes an onerous task, and may even be impractical if the owner is away from the pool for an extended period of time.

Accordingly, there have been various swimming pool cover drain means proposed to automatically drain accumulated water from swimming pool covers. An example of such an automatic swimming pool cover drain is disclosed in U.S. Pat. No. 4,318,421 issued to Geoffrey A. Ward on Mar. 9, 1982.

While effective for the purpose of automatically draining water from a swimming pool cover and accounting for foreign matter in that water, the Ward device may still have the siphon action broken if the discharge opening is not properly closed. If the siphon action is broken, the Ward device will not operate until the siphon hose is refilled. This refilling may require manual attention thereby vitiating some of the advantages of this device.

While the Ward device attempts to prevent the breaking of the siphon, it may not be able to fully protect against the possibility that the drain opening may not be closed quickly enough to prevent the breaking of the siphon action prior to the drain opening being properly occluded by the closing plug device of the mechanism.

Still further, since the Ward device, like other siphon devices, operates in water and is thus subject to corrosion. The Ward device is specifically disclosed as operating in water with foreign objects therein. Accordingly, the Ward device may be subject to having the float jam or otherwise not operate properly. In the case the float does not operate properly, the drain may not be closed by action of the float, and the siphon broken due to such malfunctioning float.

While other float operated siphon devices are known, none has elements that permit a float controlled swimming pool cover siphon discharge valve to operate quickly and fully automatically, even in the event that the water level in the reservoir of water being drained drops below a level that might break the siphon action prior to the occluding of the drain opening.

Accordingly, there is need for a swimming pool cover drain mechanism that is fully automatic, and has the ability to effectively preclude the possibility of breaking the siphon action prior to the closing of a drain valve.

OBJECTS OF THE INVENTION

It is a main object of the present invention to provide a swimming pool drain mechanism that is fully automatic.

It is another object of the present invention to provide a swimming pool cover drain mechanism that operates using a siphon action, yet is still fully automatic.

It is another object of the present invention to provide a swimming pool cover drain mechanism that uses siphon action and which is controlled to effectively preclude the possibility that the siphon will be broken during operation of the drain.

It is another object of the present invention to provide a swimming pool cover drain mechanism that uses siphon action and which includes means for ensuring a drain closing operation occurs even in the event the float mechanism malfunctions.

It is a specific object of the present invention to provide a swimming pool cover drain mechanism that uses a float controlled siphon action which is rapid, and which includes a control means for automatically closing a drain opening even if the level of water in the reservoir of water being drained from the pool cover drops below a level that would otherwise break the siphon before the float can cause the drain opening to be occluded.

SUMMARY OF THE INVENTION

These and other objects are accomplished by including a float mechanism in a float controlled siphon discharge valve used to drain a swimming pool cover which is designed to operate quickly and positively to close a drain and also including an automatic control mechanism that operates independently of, and additionally to, the float to close a drain even before the float reaches a drain closing location during a swimming pool cover draining operation.

The float mechanism is designed to be a second class lever, that is, a lever having the fulcrum at one end of a lever arm and the "force" acting on the other end with the "weight" between the two ends of the lever arm. In this case, the "force" is produced by the float, and the "weight" is the weight of the lever mechanism. The lever arm can be made long enough to produce a rapid, positive closing action via the lever moment whereby the drain is closed rapidly and positively.

The automatic control mechanism includes a water level sensor associated with the drain opening and means associated therewith and automatically takes over for the float control and causes the drain opening to be closed even if the float has, for some reason, not caused a closing plug to be moved into drain closing position after that drain has been opened for a draining operation should the water level drop to a level that would break the siphon.

This control mechanism includes a spring and a latch, with the latch preventing the spring from moving the plug into drain occluding position, and being released by action of the water sensor in the event that the float has not moved the plug into proper drain occluding position when the siphon would otherwise be broken during a draining operation. The automatic control means can include a microprocessor that is reset when the drain is closed and resets the spring and the latch, and then is activated to permit the sensing of the water level as soon as the drain is opened.

DESCRIPTION OF THE FIGURES

Other objects and advantages of this invention will become apparent from the following description taken in conjunction with the accompanying drawings wherein are set forth, by way of illustration and example, certain embodiments of this invention.

The drawings constitute a part of the present invention and illustrate various objects and features thereof.

DETAILED DESCRIPTION OF THE PREFERRED EMBODIMENT

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
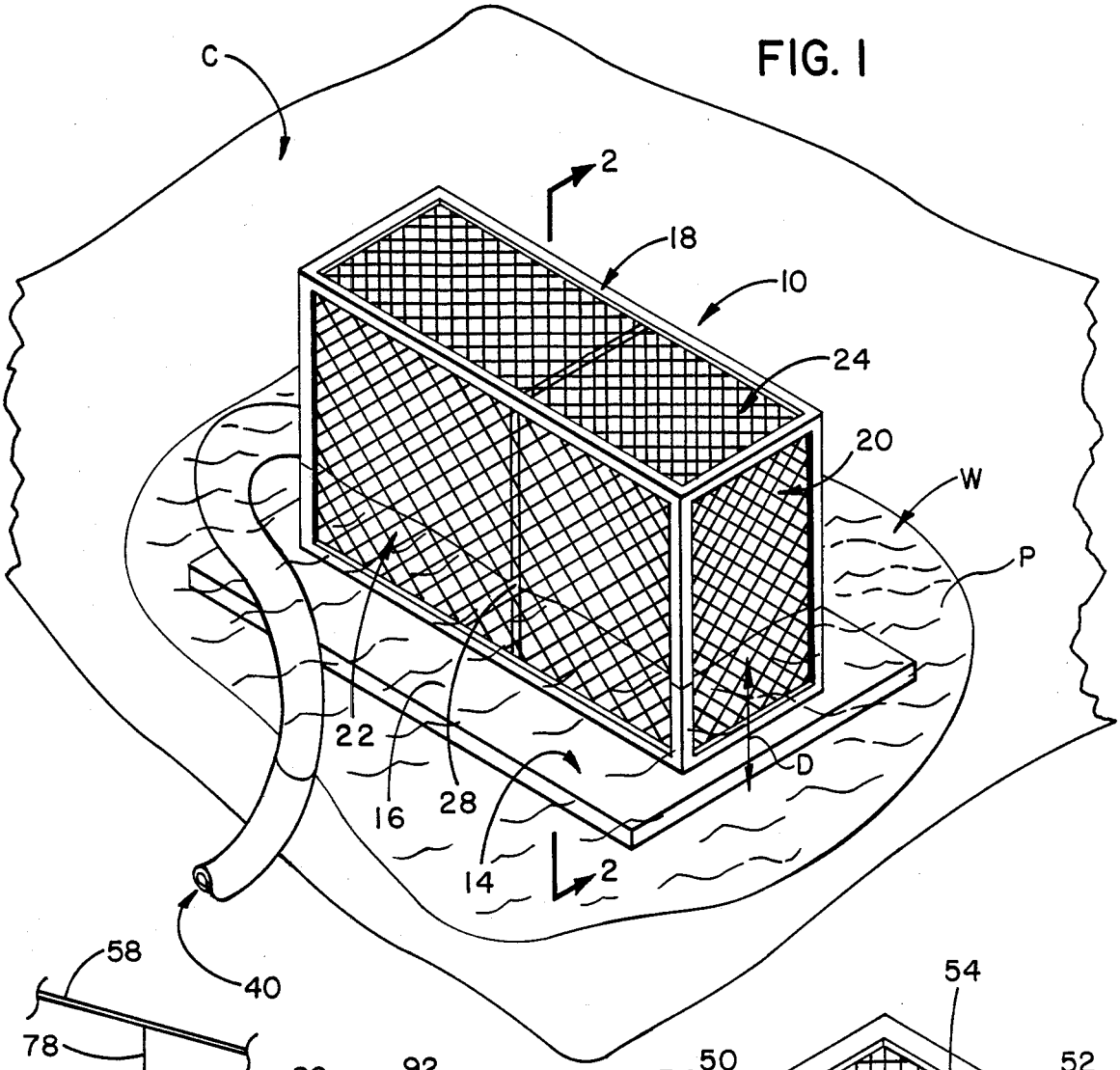
FIG. 1 is a perspective view of the float controlled siphon discharge valve mechanism embodying the present invention.

Shown in FIG. 1 is a float controlled siphon discharge valve mechanism 10 for siphoning accumulated water W from a depression formed in a swimming pool cover C. The swimming pool cover C is shown in FIG. 1 schematically, but those skilled in the art will readily recognize the characteristics of such an element. The swimming pool deck, lip and the like are not shown in FIG. 1 for the sake of brevity, but, again, those skilled in the art will know what such elements look like and how they are connected to the swimming pool cover C to support same in a pool covering position and orientation.

The valve mechanism 10 includes a base 14 which is adapted and sized to rest securely and stably in a depression in the swimming pool cover C. Mounted on a top surface 16 of the base 14 is a support cage 18 formed to include end walls, such as end wall 20 which are connected together by side walls, such as side wall 22, and a top wall 24. The walls and top are arranged to cooperate with each other and with the base top surface 16 to form a chamber 26 (shown best in FIG. 2). Furthermore, the walls and the top are shown as being perforated to be water permeable whereby water W accumulating in the pool cover can freely enter the support cage chamber.

Also supported on the base 14 is a guide wall 28 located to be within the cage chamber and oriented to extend upwardly from the base between the side walls and essentially parallel with the end walls whereby to form two compartments 30 and 32 (see FIG. 2) within the cage chamber. The guide wall 28 has a cutout portion 34 defined therein for a purpose to be discussed below.

As shown in FIG. 1, the accumulated water W forms a small pool of water P adjacent to the mechanism 10 and such a pool P has a depth as measured with respect to the cover indicated by the reference numeral D in FIG. 1. It has been found that most swimming pool covers can support a particular amount of water in the pool P without being damaged; however, if the pool P has a depth D greater than a predetermined amount, such cover can be damaged. Accordingly, the present mechanism 10 is designed to automatically drain the water W from the pool P as soon as the pool depth D reaches the predetermined depth above which the cover may be damaged.

It has been found that if the mechanism 10 works on a siphon action, it will be efficient and desirable for this purpose. However, if the mechanism 10 works on a siphon action, it must operate such that the siphon is not broken due to overdraining the pool P. Accordingly, the present invention is directed to establishing a rapid and efficient siphoning action by the mechanism 10 while also ensuring a rapid, effective and reliable cutoff of the siphon before the siphon action is broken.

Figure 2:
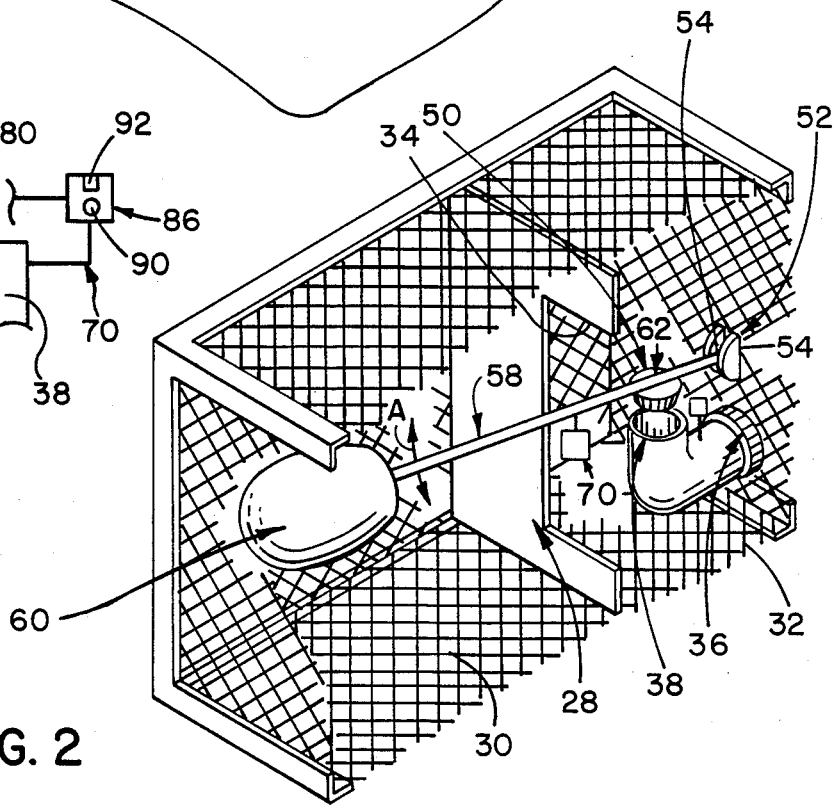
FIG. 2 is a perspective view taken along line 2—2 of FIG. 1 showing the drain control means of the present invention.

Referring next to FIG. 2, the details of the mechanism 10 are more clearly shown. The mechanism 10 includes a siphon discharge conduit connection 36 mounted on one of the end walls 20 and being adapted to fluidically connect an inlet 38 thereof to the inlet portion of a siphon discharge conduit 40, the outlet portion thereof being located beneath the swimming pool cover a distance sufficient to ensure a positive and reliable siphon action. As is well known, the siphon discharge conduit 40 is maintained full of fluid at all time to maintain the siphon action. As is also well known, if the siphon discharge conduit becomes sufficiently empty, the siphon action will either be completely broken and stop or at least will become extremely inefficient and noisy. Accordingly, the present invention is directed to preventing this from occurring by ensuring that the inlet 38, which serves as a drain opening for the mechanism, always remains open during a drain operation, but is positively and quickly closed prior to any break in the drain operation.

To this end, the mechanism 10 includes a drain opening closure means 50 associated with the drain opening 38. The closure means 50 includes a hinge 52 mounted on the end wall 20 adjacent to and above the drain opening 38. The hinge 52 includes a pair of spaced brackets, such as bracket 54, with a hinge pintle 56 extending between the brackets 54.

The closure means 50 further includes a lever arm 58 attached at one end thereof to the hinge pintle to swing toward and away from the drain opening 38 as indicated by the doubleheaded arrow A in FIG. 2. The lever arm thus forms a lever of the second or third type in which the fulcrum, in this case the hinge connection, thereof is located at one end of the lever arm and that lever arm is mounted in cantilever fashion to such fulcrum.

A float 60 is attached to the end of the lever arm that is remote from the hinge connection. The float 60 is adapted to float on the water in the pool P and to have sufficient buoyancy to move the lever arm up and down as indicated by arrow A in a manner which will be evident from the ensuing discussion.

The lever arm extends through the guide wall cutout portion 34 to be guided by the walls of the guide wall adjacent to the cutout portion during the pivoting motion of that lever arm, and a drain plug 62 is mounted on the lever arm at a location to occludingly cover the drain opening 38 when the lever arm is in a first location and to open such drain opening to receive water thereinto when the lever arm is in a second location. The plug 62 should be rapidly and positively placed in a drain opening occluding position before the siphon is broken to ensure the reliability of the mechanism 10. To this end, the lever arm 58 is of a length that is selected to provide a rapid and positive motion during the movement of the water level in the pool P. This is why the lever of the second or third type is selected. The lever arm of such a lever can be adjusted to provide a motion that is rapid and can be adjusted according to the length of the lever arm with the lever arm moments (as measured between the fulcrum and the plug 62 and between the fulcrum and the float) acting to increase the drain opening occluding action of the lever arm.

Even though the lever arm moments can be used to increase the occluding action of the plug 62, there may still be circumstances in which the float does not move quickly enough to totally prevent air from entering the drain opening. This might be the instance if, for some reason, the float arm becomes stuck in one position.

Figure 3:
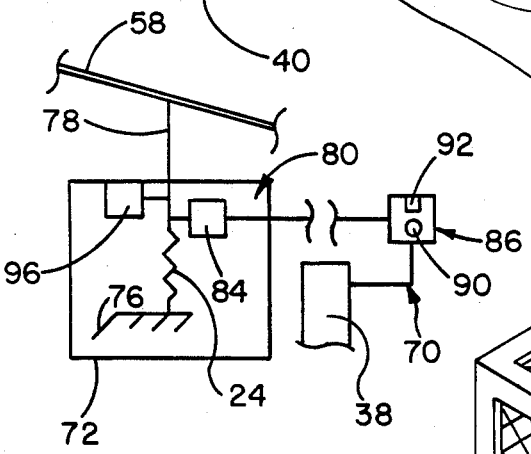
FIG. 3 is a schematic view of the automatic control means for the drain control of the present invention.

To ensure the proper closing of the drain opening, even in the instance that the lever arm becomes stuck, the mechanism 10 includes a closure means control means 70, shown in FIGS. 2 and 3. This means 70 is intended to strongly move the lever arm 58 into a drain opening occluding position. Referring to FIG. 3, it can be seen that the means 70 includes a base member 72 which is adapted to be securely mounted on the guide wall 28 adjacent to the lever arm 58. Contained in the base member 72 is a spring 74 having one end thereof connected to an immovable mount 76 and the other end thereof connected to a proximal end of a lever control arm 78 the distal end thereof being connected to the lever arm 58. The spring 74 is set to bias the lever arm 58 toward the drain opening, so that unless the spring action is interrupted, the spring will move the lever arm into the drain occluding position.

To permit the lever arm to move under the influence of the float, the control means 70 includes a spring controlling mechanism 80. The mechanism 80 includes a latch 82 which is movable from a spring capturing position to a spring releasing position by a solenoid element 84. In the spring capturing position of the latch, the bias of the spring is prevented from being communicated to the lever arm as by de-coupling the spring from the lever arm 58, or the like; whereas, in the spring releasing position of the latch, the spring is connected to the lever arm to move that lever arm. Operation of the solenoid will release or open the latch. The solenoid is controlled by a water level sensor means 86 mounted on the drain outlet 38 to locate a water sensor 90 in a position to sense the presence of water immediately adjacent to the drain opening. A microprocessor 92 is included in the means 70 to control the settings and operation thereof. Power is conducted to the unit via lines, such as line 94 from a battery pack or other such convenient source. Since the siphon action will be broken by the injesting of air into the drain, it is this condition that must be detected, and the position of the float is only a measure of this condition. The means 70 thus senses for the precise condition which is of interest and does not need any inferential steps to protect against such a condition. Locating the water sensor immediately adjacent to the drain opening permits the detection to be precise and accurately reflect the exact conditions which are of interest.

The control means 70 further includes a reset means 96 connected to the spring 74 to re-bias such spring after actuation of the means 70 as by de-coupling the spring 74 to the lever arm 58. The reset means can include any suitable mechanical or electrical elements or a combination thereof which cooperate with each other to reset the spring 74 into a condition to force the lever arm into the drain occluding position. The microprocessor is used to activate the sensing means 70 as well as to reset the means. The activation of the sensing means occurs as soon as the drain is opened so that the control means 70 operates when the mechanism is draining and is reset after the drain is occluded. The sensing means can be set to sense water so that the spring 74 is released in the event air begins to enter the drain opening even if the float has not yet moved into a position to place the plug 62 over the drain opening. This places control of the siphon action directly at the drain opening so that even if there is a ripple in the water that may not be sensed by the float, air will not be permitted to enter the drain line thereby interrupting the siphon action.

The spring 74 acts on the lever arm through a long moment arm since the lever is of the second type so that the drain closing action caused by that spring can be quick and positively close the drain before the siphon is broken.

It is to be understood that while certain forms of the present invention have been illustrated and described herein, it is not to be limited to the specific forms or arrangement of parts described and shown.

I claim:

1. A float controlled siphon discharge valve mechanism for siphoning accumulated water from a depression of a swimming pool cover out of a siphon discharge conduit having an outlet located below the level of the swimming pool cover, said valve mechanism comprising:

a support cage having a base means adapted to rest on a top surface of the swimming pool cover, water permeable end walls and water permeable side walls connecting said end walls together with said walls and said base forming a chamber in said cage, said walls permitting accumulated water to pass therethrough into said cage chamber, said cage further including a guide wall located in said chamber, said guide wall having a guiding cutout portion defined therein;

a siphon discharge conduit connection mounted on one of said end walls inside of said cage;

a drain opening having a fluid inlet located within said cage chamber and being connected to said siphon discharge conduit to direct accumulated water from inside said cage into said discharge conduit connection and into said siphon discharge conduit;

drain closure means mounted inside said cage and controlling the opening and closing of said drain opening according to the level of accumulated water on said pool cover so that accumulated water is drained from the pool cover when the water accumulates to a predetermined level on the pool cover, said drain closure means including a hinge mounted on one of said cage walls adjacent to and above said drain opening, a lever arm pivotally connected at one end thereof to said hinge so that said hinge acts as a fulcrum of a lever with said lever arm pivoting about said hinge, said lever arm being located to extend over said drain opening and through said guide wall cutout portion to be guided thereby when said lever arm pivots about said hinge toward and away from said drain opening, a float on an end of said lever arm which is remote from said hinge, said float being adapted to float on said accumulated water located in said cage chamber, and a drain closure plug attached to said lever arm at a location to be adapted to occludingly cover said drain opening for preventing water from entering said drain opening, said hinge being located so that said float will orient said lever arm to move said closure plug away from said drain opening when the level of accumulated water on said pool cover exceeds said predetermined level and will move said plug into a drain opening occluding position when the level of accumulated water on said pool cover drops below said predetermined level, said predetermined level being selected so that the siphon is not interrupted before said plug resumes the drain occluding position; and a drain closure means control means attached to said lever arm for controlling the movement of said closure means, said drain closure means control means including a control arm connected to said lever arm and a base means connected to said guide wall, a latch mechanism, and a spring connected to said control arm by said latch mechanism to move said lever arm toward said drain opening to cause said plug to occlude said drain opening when said latch mechanism is opened, said drain opening closure means control means further including a latch mechanism control means having a water sensing means located adjacent to said drain opening automatically opening said latch mechanism when the level of the accumulated water reaches a preset level to occlude said drain opening after said plug has been moved away from said drain opening by said float even though the water level of said accumulate water still exceeds said predetermined level.

2. The valve mechanism defined in claim 1 wherein said plug is frustoconical and is sized to sealingly fit into said discharge opening.

3. The valve mechanism defined in claim 2 wherein said drain closure control means further includes a reset means to reset said latch mechanism when said plug occludes said drain opening.

4. The valve mechanism defined in claim 3 wherein said latch mechanism includes a solenoid operated means for operating said latch.

5. The valve mechanism defined in claim 4 wherein said drain closure means control means includes a microprocessor.

6. A float controlled siphon discharge valve mechanism for siphoning accumulated water from a depression of a swimming pool cover out of a siphon discharge conduit having an outlet located below the level of the swimming pool cover, said valve mechanism comprising:

a support cage having a base means adapted to rest on a top surface of the swimming pool cover, water permeable end walls and water permeable side walls connecting said end walls together with said walls and said base forming a chamber in said cage, said walls permitting accumulated water to pass therethrough into said cage chamber, said cage further including a guide wall located in said chamber;

a siphon discharge conduit connection mounted on one of said end walls inside of said cage;

a drain opening having a fluid inlet located within said cage chamber and being connected to said siphon discharge conduit to direct accumulated water from inside said cage into said discharge conduit connection and into said siphon discharge conduit; and drain closure means mounted inside said cage and controlling the opening and closing of said drain opening according to the level of accumulated water on said pool cover so that accumulated water is drained from the pool cover when the water accumulates to a predetermined level on the pool cover, said drain closure means including a lever arm pivotally mounted to extend over said drain opening with said lever arm being adapted to pivot toward and away from said drain opening, a float on said lever arm, said float being adapted to float on said accumulated water located in said cage chamber, and a drain closure plug attached to said lever arm at a location to be adapted to occludingly cover said drain opening for preventing water from entering said drain opening when said float is in a drain closing position; and a drain closure means control means attached to said lever arm for moving said lever arm into an orientation with respect to said drain opening to place said closure plug in a drain occluding position when said float is still spaced from said drain closing position.

* * * * *